United States Patent [19]

Òyagi

[11] 4,186,542

[45] Feb. 5, 1980

[54] APPARATUS FOR VACUUM-SEALING A VIAL

[75] Inventor: Kenzi Òyagi, Kyoto, Japan

[73] Assignee: Takeda Chemical Industries, Ltd., Osaka, Japan

[21] Appl. No.: 915,774

[22] Filed: Jun. 15, 1978

[30] Foreign Application Priority Data

Jun. 17, 1977 [JP] Japan ..... 52/72685

[51] Int. Cl.[2] ..... B65B 31/02

[52] U.S. Cl. ..... 53/88; 53/109

[58] Field of Search ..... 53/405, 432, 88, 109

[56] References Cited

U.S. PATENT DOCUMENTS

| | | | |
|---|---|---|---|
| 2,700,497 | 1/1955 | Hall | 53/88 |
| 3,157,974 | 11/1964 | Stanley et al. | 53/88 |
| 3,824,762 | 7/1974 | Walles | 53/88 |

*Primary Examiner*—Travis S. McGehee

*Attorney, Agent, or Firm*—Wenderoth, Lind & Ponack

[57] ABSTRACT

An apparatus for vacuum-sealing a vial includes a table for receiving the vial temporarily closed with a rubber stopper, a vertically movable enclosing device having a chamber at the lower end thereof for air-tightly enclosing a mouth of the vial in the chamber to hold the vial securely on the table when the enclosing device is lowered, a rubber stopper suction head vertically movable within the chamber of the enclosing device independently thereof, a first evacuating means adapted to communicate with the chamber so as to evacuate the vial, a second evacuating device adapted to communicate with the rubber stopper suction head, whereby, after the enclosing device is lowered to enclose the vial in the chamber, the rubber stopper suction head is lowered to suck the rubber stopper and is raised to remove the rubber stopper from the mouth of the vial so as to evacuate the vial, and the rubber stopper suction head is then again lowered to vacuum-seal the vial with the rubber stopper. A cam mechanism controls the vertical movements of the enclosing device and the rubber stopper suction head, which are evacuated in timed relation to the vertical movements thereof through a valve device.

9 Claims, 13 Drawing Figures

APPARATUS FOR VACUUM-SEALING A VIAL

The present invention relates to a method and an apparatus for vacuum-sealing a vial.

It is necessary that a vial which contains a powdered injection medicine be sealed with a rubber stopper so that the inside of the vial is under a reduced pressure since gases are generated to cause the internal pressure to rise when water is added to the medicine upon its use.

One conventional apparatus for this purpose employs a method in which a rubber stopper is removed from the mouth of a vial by means of a claw mechanically operated by a cam in a vacuum chamber so as to evacuate a vial placed therein, and the rubber stopper is then fitted into the mouth of the vial. This method, however, requires a complicated mechanism and is apt to cause impure substances such as oil and dust to be mixed with the medicine in the vial during the vacuum-sealing operation. The method is therefore not desirable because of the bad effect on the quality control of the medicine. A further disadvantage in the method is that the control of opening and closing the vial is not easy since the claw is cam-operated.

According to another conventional method, which is at present in a wide use, individual batches of vials are sealed in a lyophilizer. The apparatus for carrying out the method includes a chamber which has horizontal shelves in vertically spaced relationship and which is connected to an evacuating means. A vial containing a powdered medicine is put on each shelf with the lower end of a long stopper lightly inserted into the mouth of the vial and the chamber is evacuated to evacuate the vial. After this, the lowermost shelf is elevated so that the lower face of the second lowest shelf presses the rubber stopper down against the vial on the lowermost shelf to seal the mouth of the vial. Then, the second shelf from the bottom is elevated thereby sealing the vial on that shelf in the same manner as above. This method also has the disadvantage that impure substances are apt to be mixed with the medicine in the vial since much time is required between the filling of the medicine into the vial and the sealing of the vial. Another disadvantage is that the apparatus according to the method cannot be incorporated into a conveyor system due to its batch type operation, making it difficult to achieve saving of labor with such a method.

It is therefore an object of the invention, for obviating the disadvantages involved in the prior art systems, to provide a method and an apparatus for vacuum-sealing a vial or the like which has a simple construction and which is suitable for incorporating into a conveyor line operation.

Other objects and features of the invention will be apparent from the following description with reference to the accompanying drawings, in which.

Figure 1:
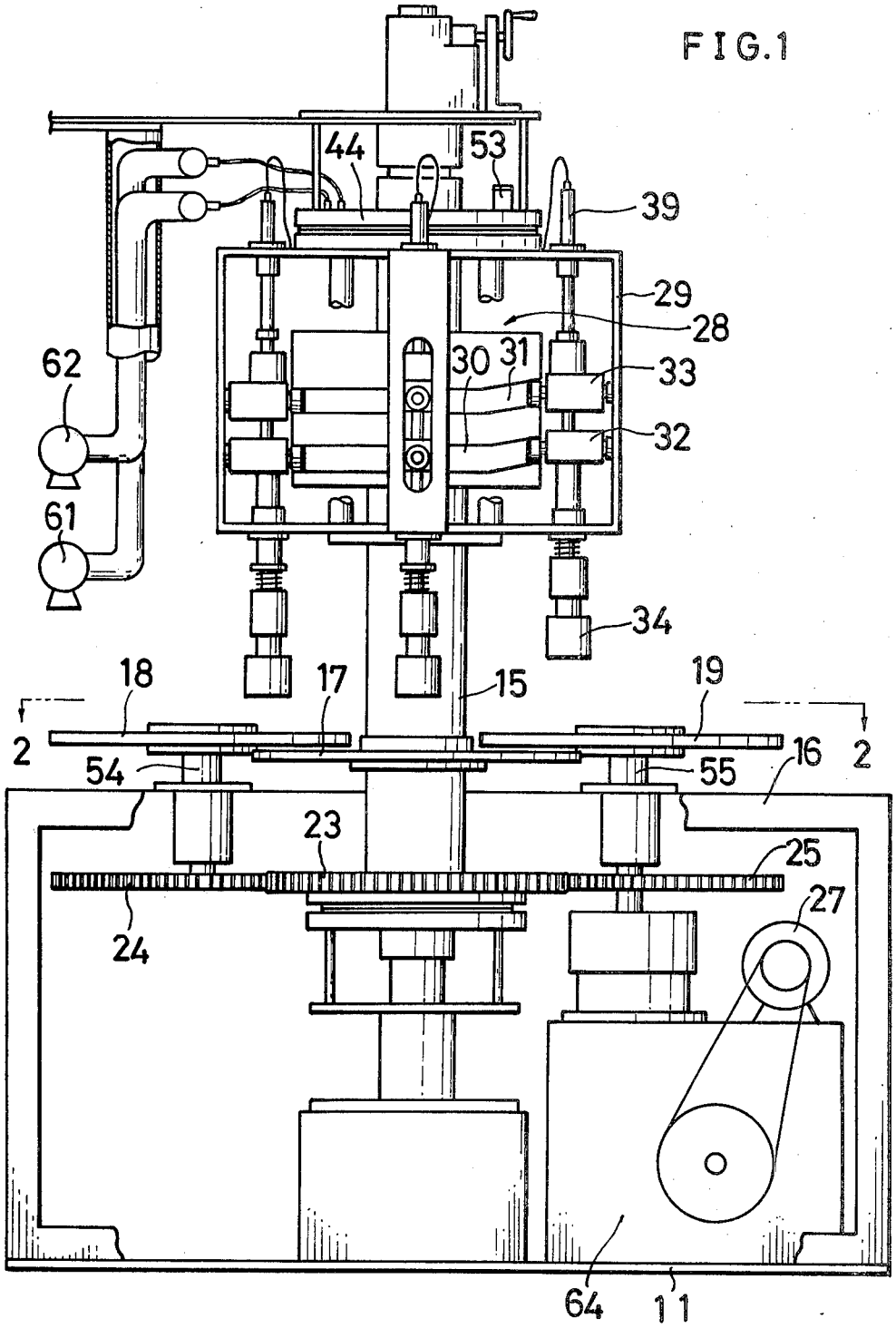
FIG. 1 is a front view of an apparatus for carrying out the method of the present invention.
Figure 3:
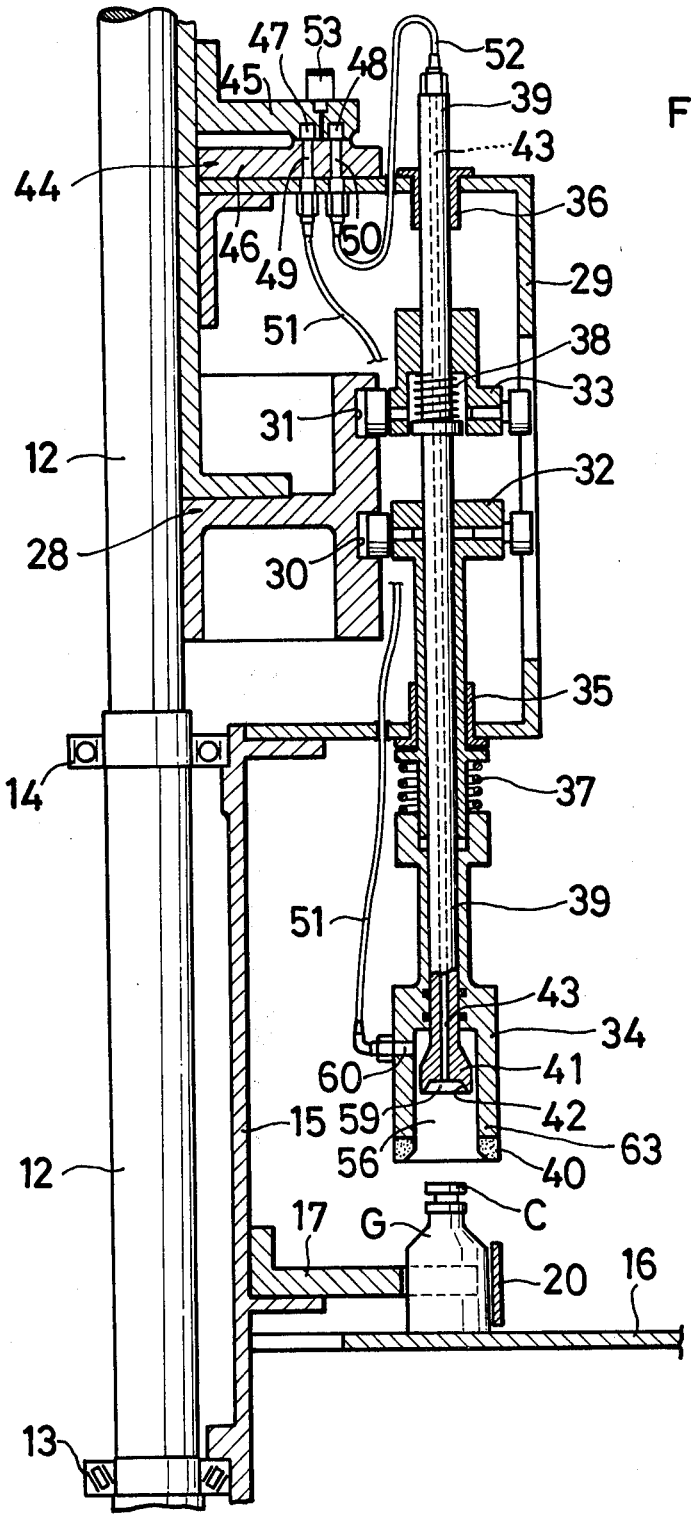
FIG. 3 is a sectional view of a main portion of the apparatus of FIG. 1.

Referring now to FIG. 1 showing an apparatus suitable for carrying out the method of the invention and FIG. 3 showing an upper main portion of the apparatus of FIG. 1, a fixed vertical shaft 12 is mounted at the center of a base 11. In the fixed shaft 12 is rotatably and coaxially mounted a main rotary shaft 15 between a thrust bearing 13 and a roller bearing 14 interposed between the two shafts 12 and 15. A table 16 is integrally formed with the base 11 and positioned thereabove for supporting a medicine-containing vial G A main wheel 17, or a vial carrying wheel, having pockets 26 in the outer periphery thereof at intervals to receive and carry vials is fixed to the main rotary shaft 15 so as to be rotatable therewith. A vial supply wheel 18 and a vial discharge wheel 19 are fixed to rotary shafts 54 and 55, respectively, so as to be rotatable therewith, and are positioned so as to overlap with the main wheel 17 at the outer periphery thereof. The vial supply wheel 18 and the vial discharge wheel 19 also have pockets 26 similar to those in the main wheel 17 at their peripheries to receive and carry vials. Arcuate guides 20, 21 and 22 are fixed in position and extend along the outer peripheries of the wheels 17, 18 and 19, respectively, to support and guide a vial received in a pocket 26 of each wheel.

Figure 2:
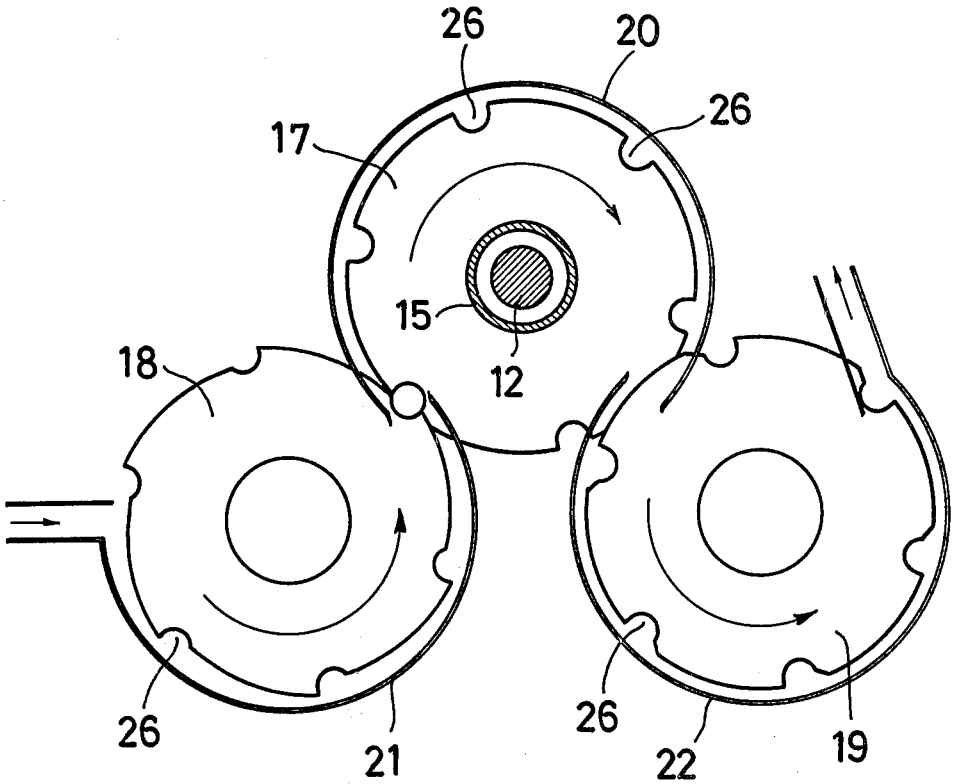
FIG. 2 is a sectional view taken on line 2—2 of FIG. 1.

The main rotary shaft 15 has a gear 23 fixed thereto under the table 16 which is driven by an electric motor 27 through a conventional reduction device within a box 64. The rotary shafts 54 and 55 also have gears 24 and 25, respectively, which engage with the gear 23 on the main rotary shaft 17 so that, for example, when the main wheel 17 rotates clockwise, the vial supply wheel 18 and the vial discharge wheel 19 rotate counterclockwise as shown by arrows in FIG. 2, and a pocket 26 of one wheel is positioned coaxially with a pocket of another wheel at a predetermined intervals of time during the rotation of the wheels, whereby a vial supplied to the vial supply wheel 18 is received in a pocket of the main wheel 17, and transferred from there into a pocket of the vial discharge wheel 19.

To the fixed shaft 12 is fixed a cylindrical cam 28 which has a first cam groove 30 and a second cam groove 31 formed on the outside thereof. In the first cam groove 30 and the second cam groove 31 engage a first cam follower 32 and a second cam follower 33, respectively, through both of which a spindle 39 extends.

A plurality of frames 29 are fixed to the main rotary shaft 15 so as to be rotatable therewith, and the upper and lower members of the frames extend radially from the shaft 15. The spindle 39 is secured to the upper member of the frame 29 so as to be vertically movable above a pocket 26 of the main wheel 17 by a bearing 36 mounted on the frame 29.

The first cam follower 32 is supported on the lower member of the frame 29 so as to be vertically movable in engagement with the first cam groove 31, independently of the spindle 39, by a bearing 35 mounted on the lower member of the frame 29, and has at the lower end portion thereof an enclosing means 34 telescopically engaging therewith and cushioned by a spiral spring 37.

The spindle 39 is air-tightly extended into the enclosing means 34 and is movable along and the enclosing means 34 independently of any movement of the enclosing means, and has at the lower end thereof a rubber stopper suction head 41 which is vertically movable together with the spindle 39 within the chamber and which opens at the lower end only. The chamber 56 is adapted to communicate with a sliding valve 44 through a first flexible tube 51 such as a rubber tube, through which the chamber 56 is evacuated. At the lower edge of the enclosing means 34 is an annular packing 40 which, upon the lowering of the means 34, abuts the shoulder of a vial not only to enclose the vial and seal the mouth thereof against the atmosphere but also to hold the vial securely within the chamber 56.

The rubber stopper suction head 41 has a tapered inner face 42 forming a dish-like hollow 59 open at the lower end thereof which communicates with an air passage 43 extending through the spindle 39. The air passage 43 is connected at the upper end of the spindle 39 with a second flexible tube 52 such as a rubber tube which is in turn connected with the sliding valve 44. The tapered face 42 is so formed that the inside diameter thereof is larger than the outside diameter of a vial G at the lower end of the hollow 59 and smaller at the deeper portions of the hollow 59, whereby the rubber stopper C is mechanically pushed into or sucked into the hollow 59 so as to be held against the inner face 42 of the suction head 41. The inner face 42, however, is not limited in its shape to the shape shown, as can readily be understood, and can have various shapes other than the tapered shape.

In the second cam groove 31 is engaged the second cam follower 33, which is connected to the spindle 39 with a spiral spring 38 providing a cushion therebetween, whereby the spindle 39 moves vertically following the movement of the cam follower 33.

The sliding valve 44 comprises a fixed member 45 fixedly secured to the fixed shaft 12 and a rotary member 46 fixedly mounted on the upper radial members of the frames 29. These two members 45 and 56 are in an air-tightly slidable relationship at the surface therebetween, to which a lubricating material such as grease is supplied from a lubricant reservoir 53 to keep the abutting surfaces air-tightly slidable.

Figure 4:
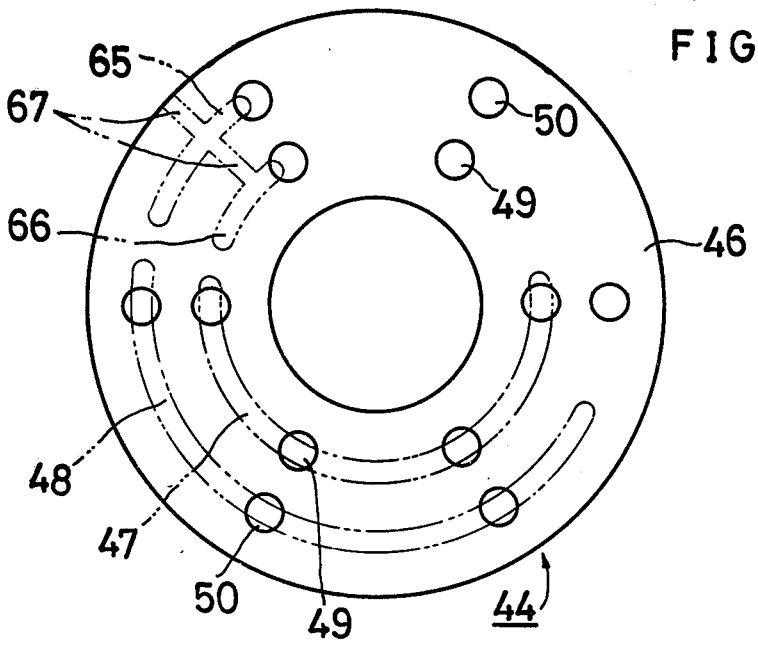
FIG. 4 is a top view of a sliding valve used in the apparatus of FIG. 1.

As shown in FIGS. 3 and 4, the fixed member 45 has two pairs of channels, one pair being vacuum channels 47 and 48, and the other pair being ventillating channels 65 and 66.

Each pair of the channels is formed on the inner face parallel to the periphery of the fixed member 45 with one channel spaced radially from the other. The first vacuum channel 47 and the second vacuum channel 48 are connected to a first vacuum pump 61 and a second vacuum pump 62, respectively, whereas both the first ventillating channel 66 and the second ventillating channel 65 are open to the atmosphere through a ventillating passage 67 extending across the channels 65 and 66 so as to open at the peripheral edge of the fixed member 45.

The inner face of the rotary member 46 forms the mating surface with the inner face of the fixed member 45. The rotary member 46 is provided with a plurality of pairs of openings 49 and 50 corresponding to the number of pockets in the main wheel 17. Each pair of openings consists of a first opening 49 and a second opening 50. The first opening 49 communicates with the chamber 56 of the enclosing means 34 through the first flexible tube 51 and a hole 60 extending through the wall 63 of the chamber 56. On the other hand, the second opening 50 communicates with the air passage 43 at the upper end of the spindle 39.

Furthermore, the first opening 49 is arranged to communicate with the first vacuum channel 47 for a predetermined time and then with the first ventillating channel 66 as the main wheel 17 rotates with the main rotary shaft 15. Similarly, the second opening 50 is arranged to communicate with the second vacuum channel 48 for a predetermined time and then with the second ventillating channel 65 as the main wheel rotates.

In place of the ventillating channels 65 and 66 combined with the path 67 extending thereacross to the peripheral end of the fixed member 45, a slit or an apperture, not shown, which extends axially through the fixed member 45 can be used for communicating the openings 49 and 50 with the atmosphere.

Figure 6:
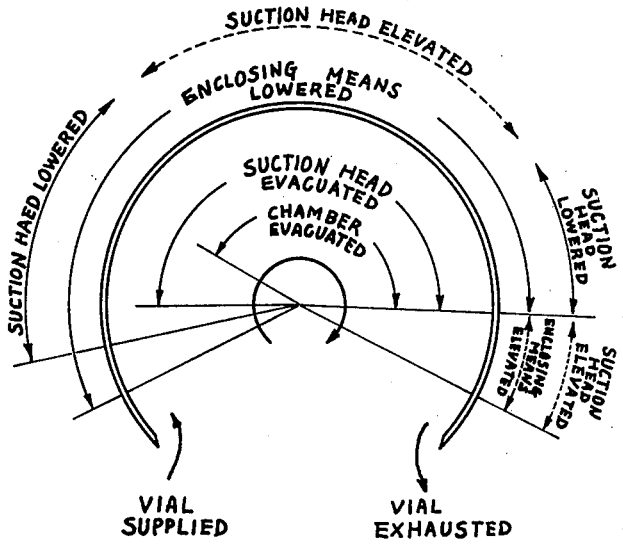
FIG. 6 is a diagram of the operation of the sliding valve of FIG. 4 controlling the vertical movements of an enclosing means and the rubber stopper suction head in timed relation to the evacuation thereof by the sliding valve.

With the sliding valve 44 constructed as described it will be understood from the diagram shown in FIG. 6, for example, that the rubber stopper suction head 41 is evacuated when the second vacuum opening 50 communicates with the second vacuum channel 48, and the chamber 56 is evacuated when the first opening 49 communicates with the first vacuum channel 47, while the main wheel 17 rotates. When the main wheel 17 further rotates, the openings 49 and 50 then communicate with the ventillating channels 66 and 65 to be open to the atmosphere.

Figure 5A:
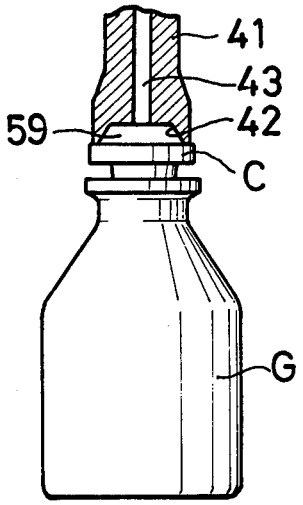
FIGS. 5A and 5B are sectional views of a rubber stopper suction head for sucking and holding a rubber stopper used in the apparatus of the invention.
Figure 5B:
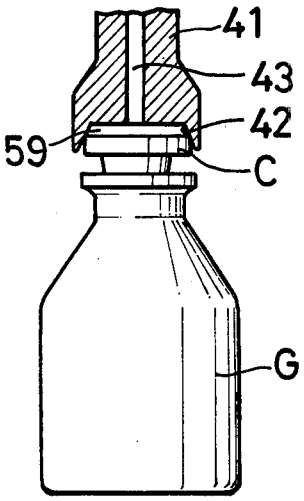

It is desirable that the air passage 43 be evacuated to a higher degree of vacuum than the chamber 56 so that the rubber stopper is fast held on the suction head 41 since the rubber stopper should be held by the suction head in the chamber which is also evacuated. The preferable pressure difference, although depending upon the weight of the rubber stopper, suction area effective for sucking the rubber stopper, the shape and size of the rubber stopper, conditions of the temporary fitting of the rubber stopper into the mouth of a vial and other factors, is at least 30 Torr when the lower edge of the rubber stopper suction head 41 abuts the upper flat face of the rubber stopper as shown in FIG. 5A. For example, when the second tube 52 is evacuated so that the pressure in the tube is 5 Torr, the pressure inside the chamber 56 is controlled to be 35 Torr to 50 Torr. However, when the upper part of the rubber stopper is inserted into the dish-like hollower 59 of the rubber stopper suction head 41 with the tapered face abutting the outer periphery of the stopper, as shown in FIG. 5B, the rubber stopper can be held on the suction head 41 under a slight pressure difference or no difference due to the mechanical gripping of the stopper by the tapered face 42 of the rubber stopper suction head 41.

FIG. 6 also shows an example of controlling the vertical movement of the enclosing means 34 through the engagement of the first cam follower 32 with the first cam groove 31, and of the suction head 41 through the engagement of the second cam follower 33 with the second cam groove 31, in timed relation to the evacuation of the rubber stopper suction head 41 and of the chamber 56 during the rotation of the main wheel 17.

Figure 7:
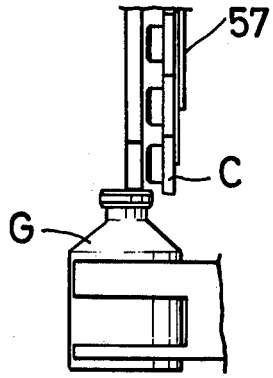
FIGS. 7 to 12 are sectional views illustrating the operation of the apparatus of the invention.
Figure 8:
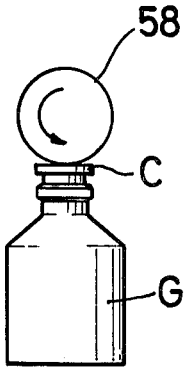
Figure 9:
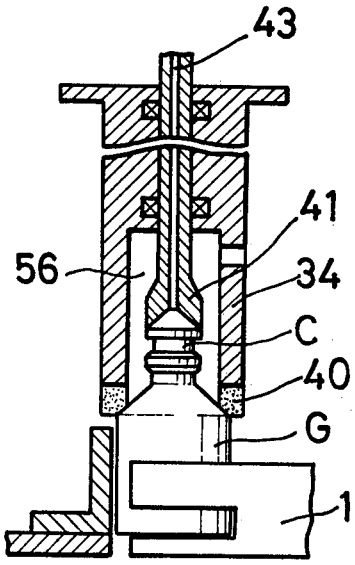

In operation, a rubber stopper C is placed in the mouth of a vial G which contains a powdered injection medicine by means of a stopper feeder 57, for example as shown in FIG. 7, and the rubber stopper is then pressed lightly with a rotary roller 58 so that the stopper will not fall out of the mouth of the vial, as shown in FIG. 8, while the vial is carried by the vial supply wheel 18, for example. The vial thus closed temporary with the rubber stopper is then fed to a pocket 26 of the main wheel 17.

As the vial is received in the pocket and carried by the rotation of the main wheel 17, the first cam follower 32 also rotating with the main wheel 17 causes the enclosing means 34 to be lowered due to the engagement of the first cam follower 32 with the first cam groove 30, until the annular packing 40 abuts the tapered shoulder of the vial to receive the upper portion thereof in the chamber 56, thereby positioning the vial precisely at the center of the chamber 56 and securely holding the vial in position on the table 16 as well as blocking the mouth of the vial from the atmosphere by the engagement of the lower edge of the chamber 56 with the tapered shoulder of the vial.

During this blocking of the mouth of the vial, the second cam follower 33 engaged with the second cam groove 31 causes the spindle 39 having at the lower end thereof the rubber stopper suction head 41 to be lowered so that the lower edge of the rubber stopper suction head 41, or the annular edge around the hollow 59, makes contact with the upper face of the rubber stopper C, as shown in FIG. 5A. Depending upon the size and shape of the rubber stopper suction head 41, or of the rubber stopper, the rubber stopper suction head 41 will receive the rubber stopper in the hollow 59 thereof with the upper periphery of the rubber stopper abutting the inner face 42 of the suction head 41, as shown in FIG. 5B. After this, the rubber stopper suction head 41 is evacuated to suck the rubber stopper through the communication of the second opening 50 with the second vacuum channel 48 which is connected to the second vacuum pump 62.

Figure 10:
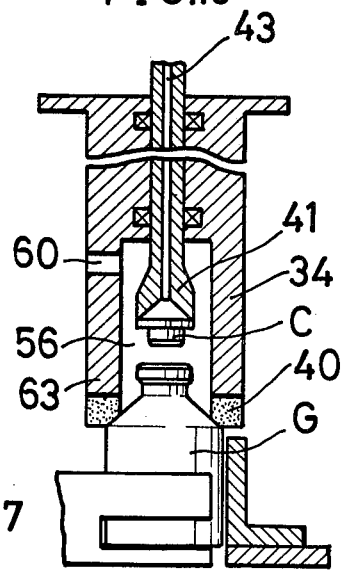
Figure 11:
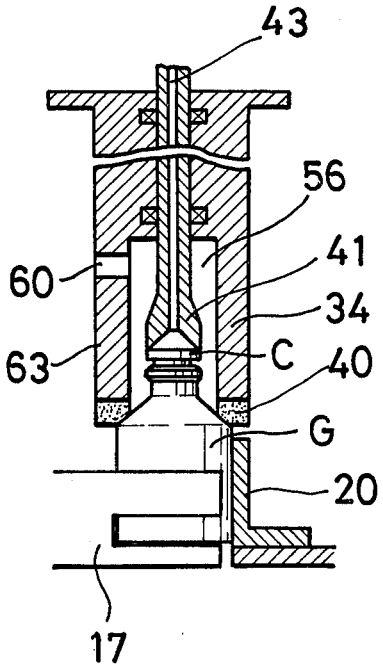
Figure 12:
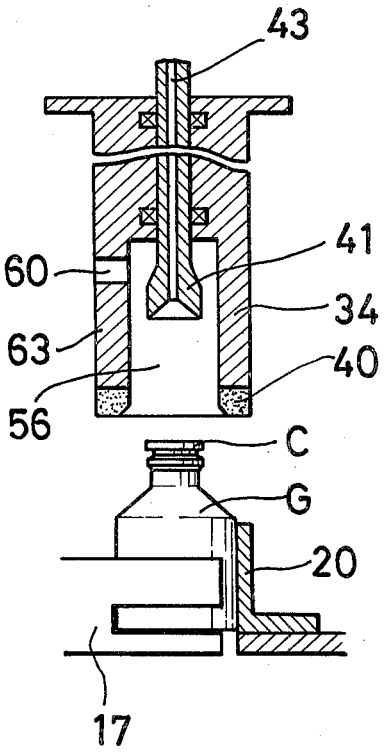

After the suction head 41 is elevated by the elevation of the second cam follower 33 to remove the rubber stopper out of the mouth of the vial, as shown in FIG. 10, the chamber 56 of the enclosing means 34 is evacuated by the communication of the first opening 49 with the first vacuum channel 47 which is connected with the first vacuum pump 61 so as to evacuate the vial air-tightly enclosed in the chamber 56 for a predetermined time as the vial is carried by the main wheel 17 according to the diagram shown in FIG. 6, followed by the lowering of the suction head 41 to vacuum-seal the vial with the rubber stopper as shown in FIG. 11.

After the vacuum-sealing of the vial, the first opening 49 and the second opening 50 then communicate with the first ventillating channel 66 and the second ventillating channel 65, respectively, due to the further rotation of the main wheel 17, whereby the chamber 56 and the rubber stopper suction head 41 are opened to the atmosphere. Both of the enclosing means and the suction head are then elevated according to the diagram. The vial thus vacuum-sealed is fed to the discharge wheel 19 to be taken out from the apparatus.

If desired, the rubber stopper suction head 41 can be at first lowered to suck the rubber stopper, and then the enclosing means 34 can be lowered, followed by the removal of the rubber stopper and the evacuation of the chamber and the vial. It can be readily understood that by a slight modification of the diagram as above described the modified operation can be performed.

As above described, since the mouth of the vial is always covered by the enclosing means during the vacuum-sealing, and the rubber stopper is removed from the mouth of the vial while it is within the chamber of the enclosing means by the suction head according to the invention, the possibility of impure substances being mixed with the medicine in the vial during the vacuum-sealing is greatly reduced. Furthermore, when the vial is supplied to the vial supply wheel with the rubber stopper temporarily closing the vial, no impure substances will be mixed with the medicine during the feeding of a vial to the apparatus.

The invention has a further advantage in that since the operation proceeds without interruption, the method and the apparatus are suitable for incorporating into a completely automatic conveyor system, thereby reducing the amount of labor needed in the sealing operation to a great extent.

I claim:

1. An apparatus for vacuum-sealing a vial comprising:

a base having a shaft fixed therein;

a table on said base supporting a vial temporarily closed by a rubber stopper;

a first rotary means for carrying the vial along said table around a vertical axis;

a vertically movable enclosing means above said table and movable downwardly for air-tightly enclosing therein the mouth of the vial and holding the vial securely on the table;

a rubber stopper suction head vertically movable within the enclosing means for engaging the rubber stopper and applying a vacuum thereto for withdrawing it from the vial; said enclosing means and suction head being movable around said vertical axis;

a cylindrical cam fixed to said shaft;

a first cam follower movable around said shaft and engaging with the cylindrical cam and connected to said enclosing means for moving the enclosing means vertically;

a second cam follower movable around said shaft and engaging with the cylindrical cam and connected with said suction head for moving said suction head vertically within the enclosing means in timed relation to the vertical movement of the enclosing means;

a first evacuating means adapted to communicate with the enclosing means;

a second evacuating means communicating with the rubber stopper suction head for applying vacuum to the stopper in timed relation to the evacuation of the enclosing means; and a valve device for communicating the enclosing means with the first evacuating means and for communicating the rubber stopper suction head with the second evacuating means independently of each other in timed relation to the lowering of the rubber stopper suction head and of the enclosing means;

whereby, while the vial is carried by the first rotary means, the enclosing means air-tightly encloses therein the mouth of the vial, and when the rubber stopper suction head is lowered the rubber stopper is drawn against it, and then said suction head elevates to remove the rubber stopper from the mouth of the vial, and the enclosing means is evacuated in timed relation to the evacuation of the rubber stopper suction head, thereby permitting the evacuation of the vial within the enclosing means for a predetermined time, and the rubber stopper suction head is then lowered to close the vial with the rubber stopper.

2. An appararatus for vacuum-sealing a vial as claimed in claim 1 wherein said enclosing means has at the lower end thereof a chamber which is open at the lower end thereof to receive and enclose the mouth of the vial therein in air tight relationship so as to hold the vial securely on the table when the enclosing means is lowered, said chamber being communicated with said first evacuating means for evacuation of the vial within the chamber.

3. An apparatus for vacuum-sealing a vial as claimed in claim 1 wherein said rubber stopper suction head has an annular edge around a hollow provided at the lower end of the rubber stopper suction head, said edge abutting the upper face of the rubber stopper when the rubber stopper suction head is lowered.

4. An apparatus for vacuum-sealing a vial as claimed in claim 1 wherein said rubber stopper suction head has an annular edge around a hollow provided in the lower end of the rubber stopper suction head for receiving the rubber stopper when the rubber stopper suction head is lowered.

5. An apparatus for vacuum-sealing a vial as claimed in claim 1 wherein said first rotary means is fixed to the rotary shaft and has a plurality of pockets in the periphery thereof at intervals therearound, and wherein said cylindrical cam has a first cam groove and a second cam groove, the first cam groove having the first cam follower engaged therein, said first cam follower having the enclosing means at the lower end thereof, and the second cam groove having the second cam follower engaged therein, and said valve device comprises a fixed member and a rotary member slidably abutting each other in air-tight slidable relationship, one of the members of said valve device having a first vacuum passage for connection to a first vacuum pump, a second vacuum passage for connection to a second vacuum pump, and a ventillating means communicating with the first and second vacuum channels and with the atmosphere, the first vacuum passage and the second vacuum passage being channels in one abutting face of said fixed and movable members parallel to the periphery of the channeled member, and the other member having a first opening and a second opening, the first opening communicating with the chamber of the enclosing means and with the first vacuum channel, and the second opening communicating with the rubber stopper suction head and with the second vacuum channel while the rotary member rotates.

6. An apparatus for vacuum-sealing a vial as claimed in claim 5 further comprising:

a means connected to the fixed member of said valve device for supplying a lubricant material to the abutting surfaces of the members of the valve device for keeping the abutting surfaces slidable.

7. An apparatus for vacuum sealing a vial as claimed in claim 1, in which said fixed shaft is a vertical shaft along said vertical axis, said apparatus further comprising:

frame means rotatable around said fixed shaft;

a spindle supported by the frame means for vertical movement above a pocket of said first rotary means, the spindle being connected to the second cam follower and having at the lower end thereof said rubber stopper suction head, said spindle having an air passage extending longitudinally therethrough and communicating with the hollow in the rubber stopper suction head and adapted to communicate with the second vacuum pump through said valve device.

8. An apparatus for vacuum-sealing a vial as claimed in claim 1 further comprising:

a second rotary means for supplying a vial to the first rotary means; and a third rotary means for receiving the vial from the first rotary means, both said second and third rotary means having a plurality of pockets at intervals in the peripheries thereof and overlapping with the first rotary means at the periphery thereof so that a vial received in a pocket of the second rotary means is fed to a pocket of the first rotary means, and the vial, after being vacuum-sealed while being carried by the first rotary means, is then received in a pocket of the third rotary means to be discharged from the apparatus.

9. An apparatus for vacuum-sealing a vial as claimed in claim 1 further comprising means for applying a higher degree of vacuum to the rubber stopper suction head than to the chamber of the enclosing means.

* * * * *